US007469873B2

(12) United States Patent
Pegoraro

(10) Patent No.: US 7,469,873 B2
(45) Date of Patent: Dec. 30, 2008

(54) RE-USABLE MODULAR FORMWORK WITH IMPROVED RIBS

(75) Inventor: Mirco Pegoraro, Grantorto (IT)

(73) Assignee: Geoplast S.p.A., Grantorto (PD) (IT)

( * ) Notice: Subject to any disclaimer, the term of this patent is extended or adjusted under 35 U.S.C. 154(b) by 797 days.

(21) Appl. No.: 11/002,857

(22) Filed: Dec. 2, 2004

(65) Prior Publication Data

US 2005/0120663 A1 Jun. 9, 2005

(30) Foreign Application Priority Data

Dec. 3, 2003 (IT) ..... PD2003A0295

(51) Int. Cl.
*E04G 9/00* (2006.01)
*E05C 5/02* (2006.01)

(52) U.S. Cl. ..... 249/192; 249/189; 292/59

(58) Field of Classification Search ..... 249/18, 249/33, 34, 40, 42, 43, 44, 45, 46, 47, 189, 249/191, 192, 193, 194, 195, 196; 292/57, 292/59, 60, 62

See application file for complete search history.

(56) References Cited

U.S. PATENT DOCUMENTS

| | | | | | |
|---|---|---|---|---|---|
| 769,374 | A * | 9/1904 | Berry | ..... | 292/57 |
| 1,123,261 | A * | 1/1915 | Edison | ..... | 249/43 |
| 2,235,949 | A * | 3/1941 | Shaw | ..... | 292/59 |
| 2,297,899 | A * | 10/1942 | Krueger | ..... | 249/45 |
| 2,970,855 | A * | 2/1961 | Fisher | ..... | 292/59 |
| 3,291,436 | A * | 12/1966 | Berghammer | ..... | 249/189 |
| 3,307,822 | A * | 3/1967 | Stout | ..... | 249/189 |
| 4,150,808 | A * | 4/1979 | Sawyer | ..... | 249/191 |
| 4,901,497 | A * | 2/1990 | Lee | ..... | 249/192 |
| 5,792,552 | A * | 8/1998 | Langkamp et al. | ..... | 249/192 |
| 6,523,323 | B2 * | 2/2003 | Worley | ..... | 249/191 |
| 2004/0261342 | A1 * | 12/2004 | Hannawa et al. | ..... | 249/191 |

FOREIGN PATENT DOCUMENTS

| | | | | |
|---|---|---|---|---|
| EP | 0 623 434 A1 * | 11/1994 | ..... | 249/189 |
| WO | WO 2004/060623 A2 * | 7/2004 | ..... | 249/191 |

* cited by examiner

*Primary Examiner*—Michael Safavi
(74) *Attorney, Agent, or Firm*—Themis Intellectual Property Counsel

(57) ABSTRACT

A re-usable modular formwork comprising at least one panel having edge ribs and transversal ribs, each of the ribs comprising two parallel walls perpendicular to the formwork panel and preferably perpendicular to the walls of the rib and to the panel. Said ribs are disposed along the perimeter of the panel and transversally to the panel. Other ribs of smaller height may be positioned diagonally within the square or rectangular areas delimited by the edge ribs and the transversal ribs. Where two or more main transversal ribs and/or edge ribs intersect, these ribs have rounded joints. Centrally in said rounded joints, there is an opening for introducing a containing rod. Other openings may be present on the edge ribs for inserting and locking closing keys.

10 Claims, 2 Drawing Sheets

RE-USABLE MODULAR FORMWORK WITH IMPROVED RIBS

CROSS REFERENCE TO RELATED APPLICATIONS

This patent application claims priority to Italian patent application PD2003A000295 filed on Dec. 3, 2003 by Applicant Mirco Pegoraro and titled "CASSERO MODULARE RIUTILIZZABILE CON NERVATURE MIGLIORATE."

STATEMENT REGARDING FEDERALLY SPONSORED RESEARCH AND DEVELOPMENT

Not Applicable.

REFERENCE TO A COMPUTER LISTING, A TABLE, OR A COMPUTER PROGRAM LISTING COMPACT DISK APPENDIX

Not Applicable.

BACKGROUND OF THE INVENTION

1. Field of the Invention

This patent application relates to the field of building construction equipment and, more specifically, to a new formwork for manufacturing concrete structures, pillars, or square or rectangular columns.

2. Description of Related Art

Formworks in the prior art are manufactured with wood panels and have a number of drawbacks, including the cost of raw materials, the need of preparing and adapting the various form boards, the instability of materials over time, a high weight, and joints with other formworks that are difficult to perform.

Formworks in plastic materials have been used with increased frequency and are based on modular elements obtained by molding a plastic material. Plastic formworks essentially comprise a plurality of retaining panels, in contact with and retaining the concrete on one side, and having stiffening ribs on the edges and transversally on the opposite side. The ribs of these plastic formwork panelss, both edge and transversal ribs, comprise a single wall perpendicular to the retaining panel. Advantages of these plastic formworks are low weight, durability over time, and easy joining with other formwork panelss.

In order to obtain plastic formworks with sufficient resistance to deformation, it is necessary to produce retaining panels of suitable thickness and/or a very high number of ribs both at the edges and in a transversal position. These ribs must also have a suitable thickness. This involves the use of a large amount of plastic material with a high production cost.

The wood formworks in the prior art used for manufacturing concrete structures, either reinforced or not reinforced, require the use of metallic retaining rods of a small diameter, to prevent the opening of the formwork due to the pressure of the poured concrete. These containing rods are positioned across the cast concrete and the parallel panels, and are retained by traction plates positioned against the panels in order to avoid their separation. Suitable spacers, made from tubular elements with enlarged ends, are positioned between two parallel panels in order to achieve a predetermined distance.

A traction plate in the prior art applies counterbalancing pressure on a panel of the wood formwork panel but may flex the panel or otherwise damage it. When the formworks are made of plastic material, the iron traction plates may damage the formwork ribs and otherwise distribute stress only over a small area. In any event, the formworks ribs must be manufactured of an appropriate thickness, in order to avoid a flexing of the panel due to the pressure of the traction plates, to possible collisions, or to axial or non-axial stresses.

BRIEF SUMMARY OF THE INVENTION

In order to overcome the above mentioned drawbacks in the prior art, a new, re-usable modular formwork with improved ribs has been developed.

It is an object of the present invention to improve the rigidity of the formworks, both overall and in specific areas of the formworks.

It is another object of the present invention to improve the distribution of non-axial or orthogonal stresses acting on the walls of the formwork.

It is still another object of the present invention to improve the distribution of the stresses exerted by traction plates on the formworks.

It is yet another object of the present invention to decrease cost and deformation over time of the formworks.

These and other advantages of the invention are achieved by the re-usable modular formwork with improved ribs of the present invention, wherein each rib, whether in an edge or transverse position in relation to the formworks, is made of two parallel walls perpendicular to the formwork panel. Between these parallel walls there are several parallel stiffening plates, preferably oriented perpendicularly to the rib walls and to the formwork panel, and positioned both along the perimeter and transversally to the formwork panel. Other ribs of smaller height are positioned in a diagonal direction on the square or rectangular areas defined by the edge or the transversal ribs.

At the intersection of two or more transverse and/or edge ribs, the ends of the ribs are mated with a circular joint. In a central position within this circle-shaped area, on the panel of the formwork, there is an opening for the passage of a containing iron rod. On the edge ribs, there are also openings for inserting and locking closing keys.

BRIEF DESCRIPTION OF THE SEVERAL VIEWS OF THE DRAWINGS

The drawings constitute a part of this specification and include an exemplary embodiment of the invention, which may be embodied in various forms. It is to be understood that in some instances various aspects of the invention may be shown exaggerated or enlarged to facilitate an understanding of the invention.

DETAILED DESCRIPTION OF THE INVENTION

A detailed description of an embodiment of the invention is disclosed herein. It should be understood, however, that the disclosed embodiment is merely exemplary of the invention, which may be embodied in various forms. Therefore, the details disclosed herein are not to be interpreted as limiting, but merely as the basis for the claims and for teaching one skilled in the art how to make and use the invention.

Figure 1:
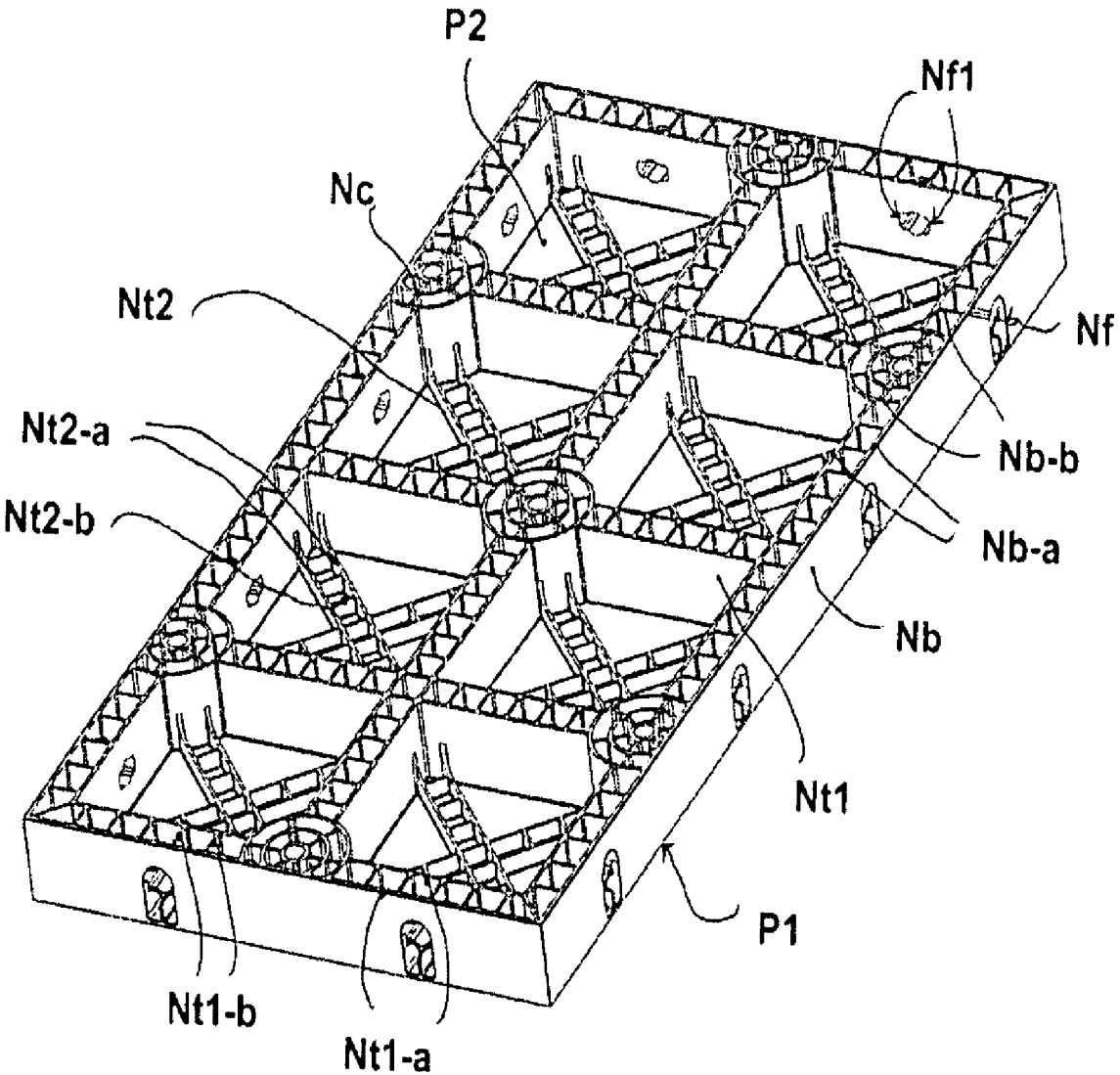
FIG. 1 is a perspective view of a formwork panel according to the present invention.

Turning now to FIG. 1, there is shown a perspective view of an embodiment of the invention, as seen from the rear surface, that is, the surface opposite to the surface in contact with the concrete. The formwork comprises a plane panel with a plurality of ribs on rear surface (P2) of the panel. Front surface (P1) has no ribs and is the internal surface of the formwork, that is, the surface in direct contact with the concrete. The plurality of ribs is perpendicular to reverse surface (P2). More specifically, the plurality of ribs is positioned along the perimeter of the panel as edge ribs (Nb) and across the panel as transversal ribs (Nt).

Transversal ribs (Nt) can be parallel to edge ribs (Nb) and/or at an angle relative to edge ribs (Nb). Preferably, a series of main transversal ribs (Nt1) are parallel to edge ribs (Nb) and divide rear surface (P2) in square or rectangular sections, while a series of minor transversal ribs (Nt2) are positioned diagonally within these square or rectangular sections.

Edge ribs (Nb) and main transversal ribs (Nt1) are each made of two parallel walls (Nb-a, Nt1-*a*) positioned at a suitable distance according to the desired rigidity level, between which there is a plurality of plates (Nb-b, Nt1-*b*) connecting said parallel walls (Nb-a, Nt1-*a*). Said plates (Nb-b, Nt1-*b*) are parallel to each other and perpendicular to walls (Nb-a, Nt1-*a*) of the rib and to the panel (P2).

Minor transversal ribs (Nt2) also comprise, in like fashion as edge ribs (Nb) and main transversal ribs (Nt1), two parallel walls (Nt2-*a*) connected by plates (Nt2-*b*), parallel to each other and perpendicular to walls (Nt2-*a*). Said minor transversal ribs (Nt2) are preferably of a lower height than edge ribs (Nb) and main transversal ribs (Nt1).

Plates (Nb-b, Nt1-*b*, Nt2-*b*) can be of the same height as walls (Nb-a, Nt1-*a*, Nt2-*a*) or of a lower height.

The design of the ribs (Nb, N1, N2) provides the formwork with greater inherent rigidity than in the prior art. In fact, the two parallel walls (Nb-a, Nt1-*a*, Nt2-*a*) connected by plates (Nb-b, Nt1-*b*, Nt2-*b*) provide a rigidity level to panel (P) that is substantially equivalent to that of a homogeneous rib of equal thickness, but with less plastic material and less weight.

At the intersection points of two or more main transversal ribs (Nt1) and/or edge ribs (Nb), the joint of the ribs is shaped as a circle or as a portion of circle (Nc), in order to provide a curved connection between transversal and/or edge ribs (Nb, Nt1). Further, said circular joint comprises two parallel walls that are concentric with radial traction plates that may be applied.

In a central position with respect to the area delimited by intersections of edge ribs and transversal ribs, there is an opening for the passage of a containing rod.

Further, there are openings (Nf) on edge ribs (Nb), preferably of circular shape, having one ore more diametrically opposite grooves (Nf1). Said openings (Nf) are arranged along edge ribs (Nb), regularly spaced and in such a position that, if various modular formwork panels are coupled, the corresponding openings (Nf) of the coupled formwork pamnels are perfectly aligned.

Figure 3:
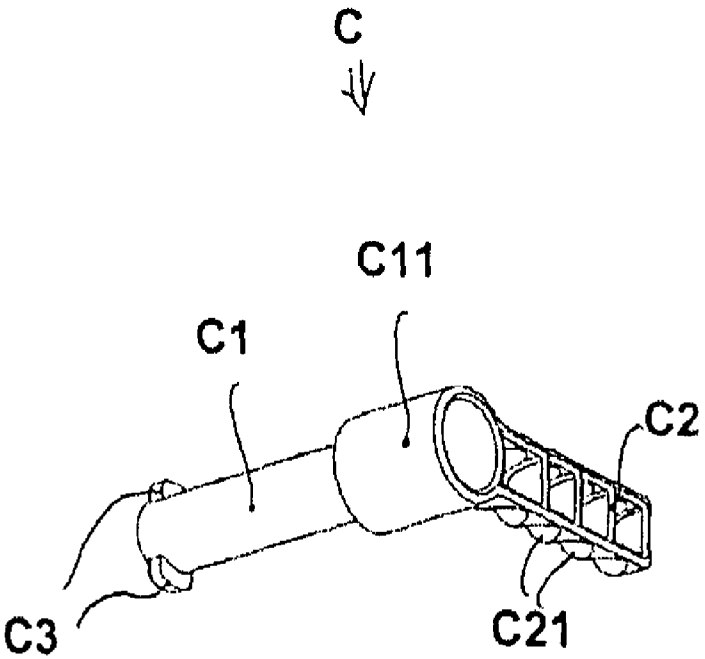
FIG. 3 is a perspective view of the closing key of FIG. 2.
Figure 2:
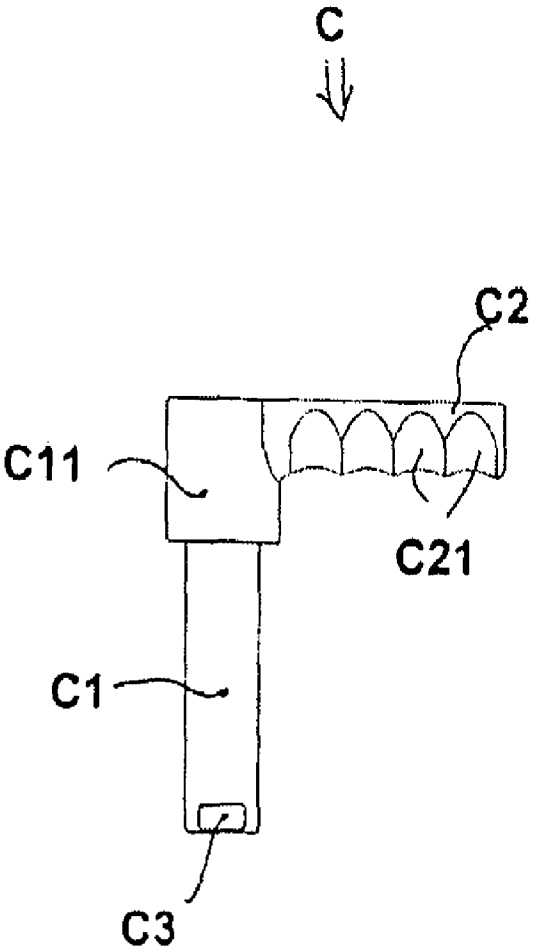
FIG. 2 is a side view of a closing key according to the present invention.

Different modular formwork panels are joined with suitable closing keys (C). FIGS. 2-3 show, respectively as a side view and as a perspective view, a closing key (C) comprising a cylindrical body (C1) with a handgrip (C2) at one end and two or more radial relieves (C3) at the opposite end.

Body (C1) of closing key (C) has a shape that is essentially cylindrical, with a diameter substantially equal to the diameter of opening (Nf) of edge ribs (Nb) of the modular formwork, and with a length larger than the thickness of two edge ribs (Nb). In particular, body (C1) has an end portion (C11) next to handgrip (C2) that has a diameter larger than the remaining part of body (C1).

At one end of body (C1) there is handgrip (C2) in a position perpendicular to body (C1) and optionally provided with relieves (C21) that facilitate a grip. At the opposite end of body (C1) there are two or more radial relieves (C3), diametrically opposite and preferably having shapes of annular segments. Said radial relieves (C3) are of such a length and width to fit through grooves (Nf1) of openings (Nf) on edge ribs (Nb) of the formwork when closing key (C) is inserted in openings (Nf).

Different modular formworks are securely joined by inserting closing key (C) in openings (Nf) of coupled edge ribs (Nb) of the modular formworks, in such a way that radial relieves (C3) of closing key (C) can extend beyond both openings (Nf), and when closing key (C) is turned, radial relieves (C3) become offset from grooves (Nf1) of openings (Nf).

Radial relieves (C3) and/or the surface of the edge ribs (Nb), in correspondence to the openings (Nf), may be wedge-shaped to facilitate compression between edge ribs (Nb) of the coupled modular formworks when closing key (C) is rotated.

The formwork of the present invention as heretofore described shows a number of advantageous features over the prior art.

Ribs (Nb, Nt1) are made of double walls (Nb-a, Nt1-*a*) with connecting plates (Nb-b, Nt1-*b*) and provide the formworks with improved resistance to bending and torsion without increasing the weight of the formwork or the amount of plastic material necessary for its production.

The greater width of ribs (Nb, Nt), while employing the same amount of plastic as in the prior art, provides the formwork with a more uniform rigidity across the entire panel of the formwork.

The circle-shaped joints (Nc) at the intersection of ribs (Nb, Nt1) enable the tension plates connected to the containing rods to exercise an appropriate and uniform pressure level. In fact, the traction plates can abut and exert pressure on two circular walls, concentric with each other and having openings for the introduction of a rod, and also on a series of radial plates positioned between these two circular concentric walls.

While the invention has been described in connection with an embodiment, it is not intended to limit the scope of the invention to the particular forms set forth, but on the contrary, it is intended to cover such alternatives, modifications, and equivalents as may be included within the spirit and scope of the invention.

What is claimed is:

1. A modular formwork in plastic material for concrete construction, comprising:

at least one panel having a first side in contact with the concrete and a second side opposite to the first side, the second side having a plurality of edge ribs and main transversal ribs, wherein the edge and main transversal ribs each comprise two parallel walls that are perpendicular to the panel, wherein the plurality of edge ribs and main transversal ribs further comprise a plurality of plates interposed between the two parallel walls and connecting the two parallel walls, and wherein the transversal ribs and edge ribs have circular joints each comprising at least two parallel walls in positions concentric with apposed radial traction plates.

2. The modular formwork in plastic material according to claim 1, wherein the main transversal ribs are parallel to the edge ribs and subdivide the second side in substantially rectangular portions.

3. The modular formwork in plastic material according to claim 1, wherein the edge ribs and main transversal ribs intersect to define substantially square areas, and wherein minor transversal ribs are positioned in diagonal directions within the substantially square area.

4. The modular formwork in plastic material according to claim 3, wherein the minor transversal ribs have a smaller height than the edge ribs and the transversal ribs.

5. The modular formwork in plastic material according to claim 1, wherein at least one circular joint comprises an opening for an introduction of a containing rod.

6. The modular formwork in plastic material according to claim 1, further comprising a plurality of openings in the edge ribs at a predetermined distance from each other, wherein different panels in the formwork may be modularly joined by aligning a pair of the openings of abutting edge ribs and inserting a closing key in the aligned pair of the openings.

7. The modular formwork in plastic material according to claim 1, wherein the plurality of plates are parallel to each other, and perpendicular to the two parallel walls and to the second side of the panel.

8. The modular formwork in plastic material according to claim 6 wherein the closing key comprises:

a cylindrical body;

a handgrip positioned at one end of the cylindrical body and perpendicular to the cylindrical body; and two or more radial relieves at the opposite end of the cylindrical body, wherein the cylindrical body has a diameter corresponding to a diameter of the openings in the edge ribs, and a length greater than a thickness of two edge ribs, and wherein the radial relieves are positioned on the cylindrical body at an angular position corresponding to an angular position of the longitudinal grooves within the substantially round openings.

9. modular formwork in plastic material according to the claim 8, wherein the radial relieves are shaped as annular segments.

10. modular formwork in plastic material according to the claim 8, wherein the radial relieves are wedge-shaped.

* * * * *